US009429158B2

(12) United States Patent
Byun et al.

(10) Patent No.: US 9,429,158 B2
(45) Date of Patent: Aug. 30, 2016

(54) AIR CONDITIONER AND COMPRESSOR HAVING POWER AND SAVING MODES OF OPERATION

(75) Inventors: Sang-Myung Byun, Changwon (KR); Sang-Mo Kim, Changwon (KR); Ho-Lim Choi, Changwon (KR); Jeong-Hun Kim, Changwon (KR); Tae-Young Noh, Changwon (KR); Jong-Won Kim, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 1601 days.

(21) Appl. No.: 13/055,189

(22) PCT Filed: Jul. 22, 2009

(86) PCT No.: PCT/KR2009/004059
§ 371 (c)(1),
(2), (4) Date: Jan. 21, 2011

(87) PCT Pub. No.: WO2010/011081
PCT Pub. Date: Jan. 28, 2010

(65) Prior Publication Data

US 2011/0120165 A1 May 26, 2011

(30) Foreign Application Priority Data

Jul. 22, 2008 (KR) ..... 10-2008-0071197
Jul. 22, 2008 (KR) ..... 10-2008-0071199

(51) Int. Cl.
*F25B 49/02* (2006.01)
*F04C 23/00* (2006.01)

(Continued)

(52) U.S. Cl.
CPC ..... *F04C 23/008* (2013.01); *F04C 28/06* (2013.01); *F04C 28/26* (2013.01); *F04C 18/356* (2013.01);

(Continued)

(58) Field of Classification Search
CPC .... F04C 28/06; F25B 49/022; F25B 49/025; F25B 2600/02; F25B 2600/021; F25B 2600/024; F25B 2600/025; F25B 2600/0251; F25B 2600/0252; F25B 2600/0262
USPC ..... 62/228.1, 230
See application file for complete search history.

(56) References Cited

U.S. PATENT DOCUMENTS 6,065,298 A * 5/2000 Fujimoto ..... F24F 11/008 62/129
6,513,341 B2 * 2/2003 Nakajima ..... B60H 1/3222 62/228.4

(Continued)

FOREIGN PATENT DOCUMENTS

CN 101191486 6/2008
JP 2005-127654 A 5/2005

(Continued)

OTHER PUBLICATIONS

Chinese Office Action dated Jan. 17, 2013.

(Continued)

*Primary Examiner* — Jonathan Bradford
(74) *Attorney, Agent, or Firm* — Ked & Associates, LLP

(57) ABSTRACT

A compressor and an air-conditioner having a compressor are provided. The air-conditioner may be operated in a pre-set operation mode according to a detected application voltage or in a pre-set operation mode according to a pre-set time domain. A compressor temperature or an ambient temperature may be detected to operate the air-conditioner in the pre-set operation mode according to the detected application voltage or in the pre-set operation mode according to the pre-set time domain to continuously operate the compressor.

20 Claims, 5 Drawing Sheets

(51) Int. Cl.

| | |
|---|---|
| ***F04C 28/06*** | (2006.01) |
| ***F04C 28/26*** | (2006.01) |
| *F04C 18/356* | (2006.01) |

(52) U.S. Cl.

CPC ..... *F04C 2240/803* (2013.01); *F04C 2270/19* (2013.01); *F04C 2270/23* (2013.01); *F04C 2270/80* (2013.01); *F04C 2270/86* (2013.01); *F25B 49/022* (2013.01); *F25B 49/025* (2013.01); *F25B 2600/024* (2013.01); *F25B 2600/0262* (2013.01)

(56) References Cited

U.S. PATENT DOCUMENTS

2006/0280627 A1* 12/2006 Jayanth ..... F04C 18/0215 417/410.5
2007/0137233 A1 6/2007 Hatano et al.
2008/0120985 A1 5/2008 Lee et al.

FOREIGN PATENT DOCUMENTS

| | | |
|---|---|---|
| KR | 10-2000-0034043 A | 6/2000 |
| KR | 10-2006-0013221 A | 9/2006 |
| KR | 10-2008-0018735 A | 2/2008 |
| WO | WO 2006/014081 | 2/2006 |
| WO | WO 2008/023962 | 2/2008 |

OTHER PUBLICATIONS

International Search Report issued in PCT Application No. PCT/KR2009/004059 dated Nov. 10, 2009.

* cited by examiner

AIR CONDITIONER AND COMPRESSOR HAVING POWER AND SAVING MODES OF OPERATION

CROSS-REFERENCE TO RELATED PATENT APPLICATIONS

This application is a U.S. National Stage Application under 35 U.S.C. §371 of PCT Application No. PCT/KR09/04059, filed Jul. 22, 2009, which claims priority to Korean Patent Application Nos. 10-2008-0071197 and 10-2008-0071199, both filed Jul. 22, 2008.

BACKGROUND OF THE INVENTION

1. Field of the Invention

The present invention relates to a compressor and an air-conditioner having the same and, more particularly, to a compressor capable of enhancing an operation efficiency in an area where an operational environment is abnormal and an air-conditioner having the air-conditioner.

2. Description of the Related Art

In general, a compressor is applied to an air-conditioner. Recently, as the functions of air-conditioners and the like are diversified, a compressor whose capacity can be changed is on demand. As a technique for varying the capacity of the compressor, a technique for controlling the number of rotations of the compressor by employing an inverter motor and a technique for mechanically controlling a vane to idly rotate it are widely known.

First, the technique employing the inverter motor has a problem in that because the inverter motor is costly, the burden of a unit cost is high, and it is difficult to increase a freezing capability in a cooling condition compared with an increase in a freezing capability in a heating condition.

Meanwhile, the technique for idly rotating the vane by mechanically controlling it includes two types of methods: The first is constraining and releasing the vane by varying the pressure of a refrigerant supplied to a compression space of a cylinder; and the second is constraining and releasing the vane while changing the pressure applied to a rear surface of the vane.

In the case of the compressor, in an area where a voltage situation is not good, a low voltage is frequently generated, and in this occurrence, motive power of the compressor is insufficient to stop the compressor. Namely, during a certain time domain during which power of the compressor is turned off, refrigerant is not compressed, failing to obtain a cooling effect to make it difficult to realize an agreeable cooling operation. If an ambient temperature is high, the compressor is stopped, so the refrigerating is not compressed during a certain time domain while power of the compressor is turned off, failing to obtain a cooling effect to make it difficult to realize an agreeable cooling operation. Because the compressor is repeatedly turned on and off, power consumption increases and the reliability is degraded.

In addition, when a discharge temperature of the compressor refrigerator is high, power of the compressor is cut off by an electric overload protection (OLP) device or a temperature sensor to thus protect the compressor. In addition, when an ambient temperature is high, the same operation is performed. In particular, in an area, such as a tropical region, in which an ambient temperature is considerably high, such operation is frequently performed. If such operation is frequently performed, the refrigerant is not compressed during a certain time domain, failing to obtain a cooling effect to make it difficult to realize an agreeable cooling operation. Also, because the compressor is repeatedly turned on and off, power consumption increases and the reliability is degraded.

In addition, with the excessively high ambient temperature, the compressor is continuously operated in a power mode, excessive cooling operation is performed even at night, failing to provide an agreeable cooling operation and causing big noise.

SUMMARY OF THE INVENTION

Therefore, in order to address the above matters, the various features described herein have been conceived.

An aspect of the present invention provides a compressor and an air-conditioner, having the compressor, operated in a pre-set operation mode or operated based on a detected compressor application voltage or operated in a pre-set operation mode during a certain time domain to continuously operate the compressor, thus improving the reliability and operation efficiency of the compressor and the air-conditioner and reducing noise.

Another aspect of the present invention provides a compressor and an air-conditioner, having the compressor, operated in a pre-set operation mode by detecting a compressor temperature or an ambient temperature, thereby improving the reliability and operation efficiency of the compressor and the air-conditioner and reducing noise.

Another aspect of the present invention provides a compressor and an air-conditioner, having the compressor, operated in a pre-set operation mode by detecting a compressor or an ambient temperature or operated in a pre-set operation mode during a certain time domain to continuously operate the compressor, thus improving the reliability and operation efficiency of the compressor and the air-conditioner and reducing noise.

According to an aspect of the present invention, there is provided a compressor including: a casing having a hermetically closed internal space; a driving motor installed in the internal space of the casing and generating a driving force; and a compression unit installed along with the driving motor in the internal space of the casing, having at least two or more compression spaces, and controlled to be operated in a power mode or in a saving mode in which the compression unit is idly rotated in at least one compression space, according to a compressor application voltage. Here, if the application voltage is lower than a reference voltage, the compression unit controls the compressor to be operated in the saving mode, and when the application voltage is equal to or higher than the reference voltage, the compression unit controls the compressor to be operated in the power mode.

According to another aspect of the present invention, there is provided a compressor including: a casing having a hermetically closed internal space; a driving motor installed in the internal space of the casing and generating a driving force; and a compression unit installed along with the driving motor in the internal space of the casing, having at least two or more compression spaces, and controlled to be operated in a power mode or in a saving mode in which the compression unit is idly rotated in at least one compression space, according to the difference between actually measured temperatures of refrigerants discharged from the compression spaces. Here, when the actually measured temperature is lower than a first reference temperature, the compression unit is changed to the saving mode, when the actually measured temperature is equal to or higher than the first reference temperature but lower than a second reference temperature, the compression unit is changed to the power mode, and when the actually measured temperatures is equal to or higher than the second reference temperature, the compression unit is changed to the saving mode.

The compression unit may be changed to one of the operation modes, e.g., to the saving mode, during a particular time domain of a pre-set time domain. Here, the time domain may be set based on, for example, an average temperature.

The compression unit may be idly rotated by using a refrigerant sucked to a suction opening of the compression unit and a refrigerant filled in the internal space of the casing.

According to another aspect of the present invention, there is provided an air-conditioner including: a compressor having a power mode in which the compressor is operated with a maximum compression capacity and a saving mode in which the compressor is operated with a smaller compression capacity than in the power mode; a detection unit configured to detect a compressor application voltage for determining an operation mode of the compressor; and a control unit configured to change an operation mode of the compressor by comparing an application voltage detected by the detection unit to a pre-set reference voltage. Here, when the application voltage is lower than the reference voltage, the control unit may control the compressor to be operated in the saving mode.

The control unit may control the operation mode of the compressor by comparing the application voltage detected by the detection unit and the reference voltage according to an application voltage detection period. If the application voltage is higher than a first reference voltage, the control unit may control the compressor to be operated in the power mode. If the application voltage ranges from a second voltage to the first reference voltage, the control unit may control the compressor to be operated in the saving mode. If the application voltage is lower than the second reference voltage, the control unit may control the compressor to be stopped.

According to another aspect of the present invention, there is provided an air-conditioner including: a compressor having a power mode in which the compressor is operated with a maximum compression capacity and a saving mode in which the compressor is operated with a smaller compression capacity than in the power mode; a detection unit configured to detect a compressor application voltage for determining an operation mode of the compressor; a control unit configured to change an operation mode of the compressor by comparing an application voltage detected by the detection unit to a pre-set reference voltage; and a temperature detection unit configured to detect an actually measured temperature for determining an operation mode of the compressor. Here, if the application voltage is higher than a first reference voltage, the control unit may control the operation mode of the compressor by comparing the actually measured temperature which has been detected by the temperature detection unit and a pre-set reference temperature according to an actually measured temperature detection period.

According to another aspect of the present invention, there is provided an air-conditioner including: a compressor having a power mode in which the compressor is operated with a maximum compression capacity and a saving mode in which the compressor is operated with a smaller compression capacity than in the power mode; a temperature detection unit configured to detect an actually measured temperature for determining an operation mode of the compressor; and a control unit for changing the operation mode of the compressor by comparing the actually measured temperature which has been detected by the temperature detection unit to a pre-set reference temperature. Here, if the actually measured temperature is higher than an upper limit of a temperature range corresponding to the power mode domain, the control unit may control the compressor to be operated in the saving mode.

Here, the control unit may control the operation mode of the compressor by comparing the actually measured temperature which has been detected by the temperature detection unit and the pre-set reference temperature according to the actually measured temperature detection period. If the actually measured temperature is lower than a first reference temperature, the control unit may control the compressor to be operated in the saving mode. If the actually measured temperature is equal to or higher than the first reference temperature but lower than the second reference temperature, the control unit may control the compressor to be operated in the power mode. If the actually measured temperature is equal to or higher than the second reference temperature, the control unit may control the compressor to be operated in the saving mode.

According to another aspect of the present invention, there is provided an air-conditioner including: a compressor having a power mode in which the compressor is operated with a maximum compression capacity and a saving mode in which the compressor is operated with a smaller compression capacity than in the power mode; and a control unit configured to change an operation mode of the compressor according to each of pre-set time domains, wherein the control unit controls the compressor to be operated in the saving mode in a particular time domain of the time domains. Here, the time domains may be set based on, for example, an average temperature.

The air-conditioner may further include: a temperature detection unit configured to detect an actually measured temperature for determining an operation mode of the compressor. The control unit compares the actually measured temperature which has been detected by the temperature detection unit to a pre-set reference temperature, and if the actually measured temperature is higher than an upper limit of a temperature range corresponding to the power mode domain, the control unit may control the compressor to be operated in the saving mode. If the actually measured temperature is lower than a first reference temperature, the control unit may control the compressor to be operated in the saving mode. When the actually measured temperature ranges from the first reference temperature to a second reference temperature, the control unit may control the compressor to be operated in the power mode. When the actually measured temperature is higher than the second reference temperature, the control unit may control the compressor to be operated in the saving mode.

Here, the temperature detection unit may be installed at a discharge side of the compressor to detect the temperature of a refrigerator discharged from the compressor, or may be installed in an air-conditioned room to detect an indoor temperature.

The compressor and air-conditioner having the same according to exemplary embodiments of the present invention have many advantages.

That is, first, because the compressor is prevented from being interrupted due to a low voltage, power consumption can be reduced and an agreeable cooling operation can be provided.

Second, because power of the compressor is not repeatedly turned on or off, power consumption can be reduced and reliability can be improved.

Third, because the compressor is operated in a particular operation mode during a certain time slot regardless of an ambient temperature, an excessive cooling is not performed especially at a night time, providing an agreeable cooling operation and reducing noise.

The foregoing and other objects, features, aspects and advantages of the present invention will become more apparent from the following detailed description of the present invention when taken in conjunction with the accompanying drawings.

DETAILED DESCRIPTION OF THE INVENTION

A compressor and an air-conditioner having the compressor according to exemplary embodiments of the present invention will now be described with reference to the accompanying drawings.

Figure 1:
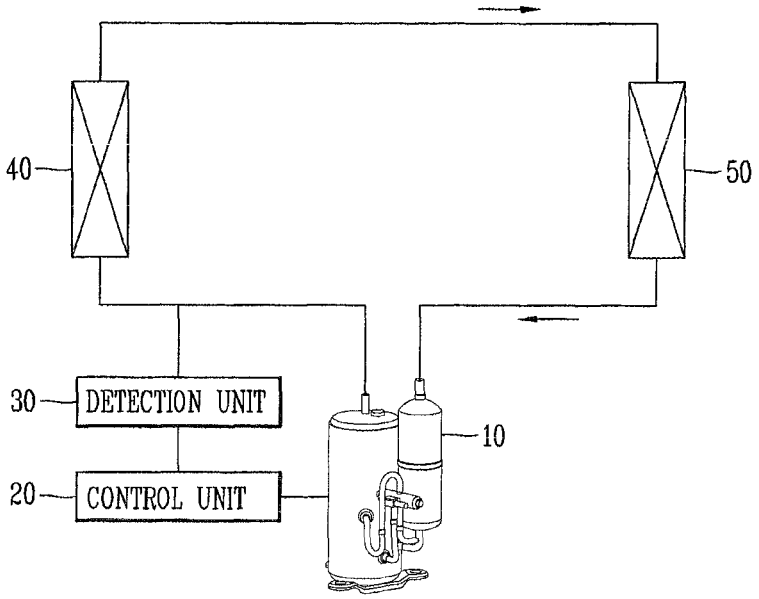
FIG. 1 is a schematic block diagram showing a system configuration to explain an air-conditioner according to a first exemplary embodiment of the present invention.

With reference to FIG. 1, the air-conditioner according to a first exemplary embodiment of the present invention includes a compressor 10 having a power mode in which the compressor 10 operates with a maximum compression capacity and a saving mode in which the compressor 10 operates with a smaller compression capacity than in the power mode; a detection unit 30 configured to detect a compressor application voltage for determining an operation mode of the compressor 10; and a control unit 20 configured to change an operation mode of the compressor 10 by comparing an application voltage detected by the detection unit 30 to a pre-set reference voltage. In addition, the air-conditioner further includes an outdoor unit 40 for controlling distribution and circulation of a refrigerant, and an indoor unit 50 shared by the outdoor unit 40 and discharging air to each room. When the application voltage is lower than the reference voltage, the control unit controls the compressor to be operated in the saving mode. Here, the reference voltage is a pre-set voltage value, at which the compressor is not stopped when a low voltage not within a compressor driving available voltage range occurs or when such a low voltage that may cause a trouble to driving of the compressor although it is within the compressor driving available voltage range. For example, if the voltage of a commercial power source is 220V and the compressor driving available voltage range ranges 187V to 253V, the reference voltage may be set as 200V and, in this case, if a voltage lower than 200V is applied as a compressor application voltage, the compressor is operated in the saving mode. For another example, when the compressor is operated in the saving mode, a voltage lower than that used for operating the compressor in the power mode is required. Thus, the reference voltage may be set as 180V by extending the compressor driving available voltage range, and if a lower voltage than the reference voltage occurs, the compressor may be operated in the saving mode.

The power mode is a compressor operation mode in which the compressor is operated with a maximum compression capacity, and the saving mode is a compressor operation mode in which the compressor is operated with a compression capacity ranging from 0 to 100% of the compression capacity of the power mode. 20%, 40%, 60% and 80% of the maximum compression capacity may be set for the saving mode, according to which the compressor may be operated, and most commonly, the compression capacity is set to be 50% to operate the compressor. This is called a two-stage mode.

The present invention is based on the two-stage mode of the power mode and the saving mode, for which every electrical or mechanical means dividing the two modes may be used.

In the air-conditioner according to the first exemplary embodiment of the present invention, the control unit 20 controls the operation mode of the compressor 10 by comparing an application voltage detected by the detection unit 30 and the reference voltage according to an application voltage detection period. Here, an actually measured temperature detection period refers to a period at which an actually measured temperature is compared with a pre-set reference temperature in real time whenever it occurs.

In the air-conditioner according to the first exemplary embodiment of the present invention, if the application voltage is higher than a first reference voltage, the control unit 20 controls the compressor 10 to be operated in the power mode. If the application voltage ranges from the first reference voltage to a second reference voltage, the control unit 20 controls the compressor 10 to be operated in the saving mode. If the application voltage is lower than the second reference voltage, the control unit 20 controls the compressor 10 to be stopped. Here, the first and second reference voltages are voltage values set by previously measuring voltages at which the compressor 10 can be driven according to the operation mode of the compressor 10.

In the air-conditioner according to the first exemplary embodiment of the present invention, one or more time domains are set, and the control unit 20 provides control to change the operation mode of the compressor according to each time domain. During a particular time domain of the time domains, the control unit 20 controls the compressor to be operated in the saving mode.

Figure 2:
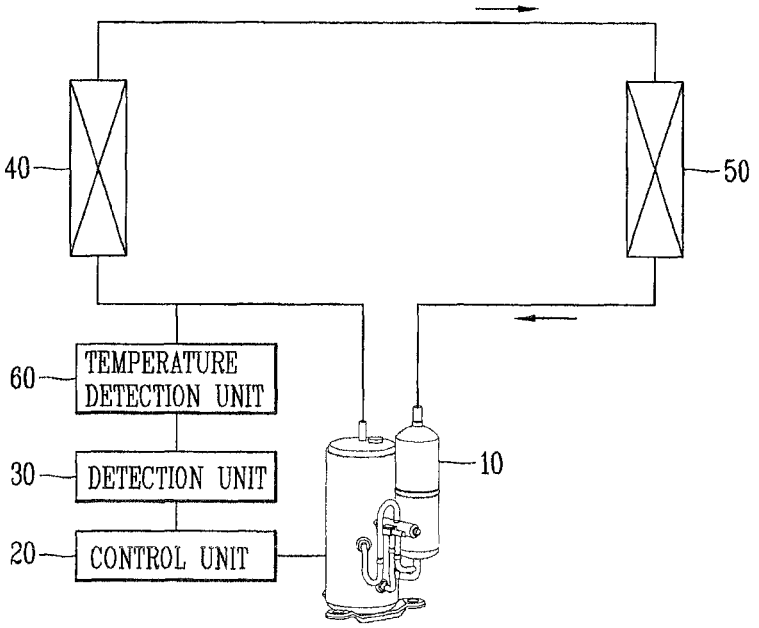
FIG. 2 is a schematic block diagram showing a system configuration to explain an air-conditioner according to a second exemplary embodiment of the present invention.

With reference to FIG. 2, an air-conditioner according to a second exemplary embodiment of the present invention includes: the compressor 10 having a power mode in which the compressor 10 operates with a maximum compression capacity and a saving mode in which the compressor 10 operates with a smaller compression capacity than in the power mode; the detection unit 30 configured to detect a compressor application voltage for determining an operation mode of the compressor; the control unit 20 configured to change an operation mode of the compressor by comparing an application voltage detected by the detection unit 30 to a pre-set reference voltage; and a temperature detection unit 60 configured to detect an actually measured temperature for determining an operation mode of the compressor. The air-conditioner further includes: the outdoor unit 40 for controlling distribution and circulation of a refrigerant, and the indoor unit 50 shared by the outdoor unit 40 and discharging air to each room. Here, if the application voltage is lower than the reference voltage, the control unit 20 controls the compressor to be operated in the saving mode. The same content as description with respect to FIG. 1 will be replaced by the description with respect to FIG. 1.

In the air-conditioner according to the second exemplary embodiment of the present invention, if the application voltage is higher than the reference voltage, namely, the application voltage is a normal voltage, an actually measured temperature is detected by the temperature detection unit 60 and determines an operation mode of the compressor 10 based on the actually measured temperature. The control unit 20 controls the operation mode of the compressor 10 by comparing the actually measured temperature detected by the temperature detection unit 60 and the pre-set reference temperature according to the actually measured temperature detection period. Here, the actually measured temperature detection period refers to a period at which the actually measured temperature is compared with the pre-set reference temperature in real time whenever the actually measured temperature detected. In addition, the reference temperature is a value set to be lower than a limit temperature of an overload protection device as installed, which is used to prevent the compressor from being stopped by the overload protection device. The temperature detection unit 60 may have the function of the overload protection device or may be installed separately from the overload protection device.

In the air-conditioner according to the second exemplary embodiment of the present invention, if the actually measured temperature is lower than a first reference temperature, the control unit 20 controls the compressor to be operated in the saving mode. If the actually measured temperature ranges from the first reference temperature to a second reference temperature, the control unit 20 controls the compressor to be operated in the power mode. If the actually measured temperature is higher than the second reference temperature, the control unit controls the compressor to be operated in the saving mode. Here, the first reference temperature is a reference temperature value used for discriminating the saving mode and the power mode. The temperature range from the first reference temperature to the second reference temperature corresponds to a power mode domain. The second reference temperature is an upper limit temperature value of the temperature range corresponding to the power mode domain set to be lower than the limit temperature of the overload protection device in order to prevent the compressor from being stopped.

Here, the temperature detection unit 60 may be installed at a discharge side of the compressor to detect the temperature of a refrigerant discharged from the compressor, or may be installed in an air-conditioned room to detect an indoor temperature.

Figure 3:
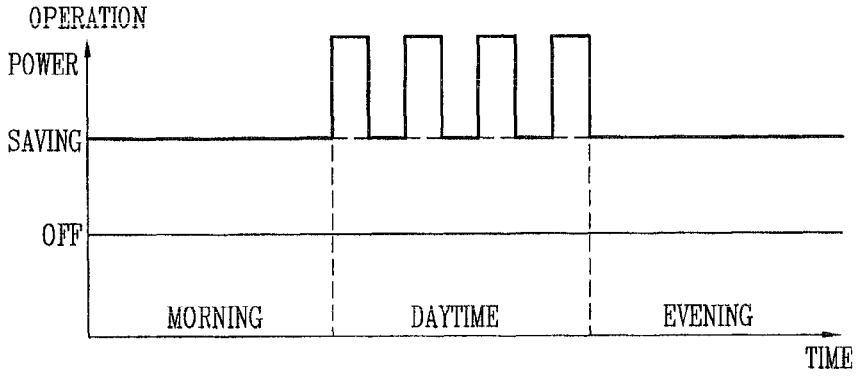
FIG. 3 is a graph showing a change in a compressor operation mode in FIG. 1 or 2.

FIG. 3 is a graph showing a change in the compressor operation mode according to a first or second exemplary embodiment of the present invention. As shown in FIG. 3, time is divided into morning time, daytime, nighttime slots, and the operation modes include two modes: the power mode and the saving mode.

First, when the user turns on power of the compressor, sets a desired temperature and drives the air-conditioner, the compressor is operated in the power mode so as to be driven to make an indoor temperature reach a user desired temperature. In addition, in a state that a certain temperature is previously set, if the temperature is lower than the pre-set certain temperature, the compressor is operated in the saving mode, whereas if the temperature is higher than the pre-set certain temperature, the compressor is operated in the power mode. Here, with the air-conditioner according to an exemplary embodiment of the present invention, for example, as shown in the morning time slot in FIG. 3, if a detected compressor application voltage is lower than the reference voltage, namely, if the compressor application voltage is low, the operation mode of the compressor is changed to the saving mode, in which the compressor can be operated even at the low voltage, so as to be driven the compressor at the low voltage without being stopped.

In the related art air-conditioner operation method, the operation of the compressor is stopped at a daytime slot during which an average temperature is high because an ambient temperature exceeds the limit temperature of the overload protection device. When the compressor is driven again by applying power thereto, because the ambient temperature exceeds again the limit temperature of the overload protection device, stopping the operation of the compressor. In a tropical area, in particular, during a daytime slot during which an average temperature is high, power of the compressor is repeatedly turned on or off, failing to provide an agreeable cooling operation and increase power consumption.

In comparison, according to the air-conditioner operation method according to an exemplary embodiment of the present invention, because the reference temperature is set to be lower than the limit value of the overload protection device and set for the upper limit of the temperature range of the power mode domain, and when an actually measured temperature is higher than the reference temperature, the compressor is forcibly changed to the saving mode and operated, thereby reducing power consumption and noise according to operation of the compressor such as a compressor operation noise and the like.

In an area where an ambient temperature is high, the high temperature is still maintained at an evening time (or nighttime) slot, so the compressor tends to be operated in the power mode. However, in the air-conditioner according to an exemplary embodiment of the present invention, a particular time domain is set, so that the compressor is operated in the particular operation mode. That is, for example, the compressor is operated in the saving mode during the nighttime slot, rather than being continuously operated in the power mode, thus preventing an excessive cooling operation and reducing noise.

Figure 4:
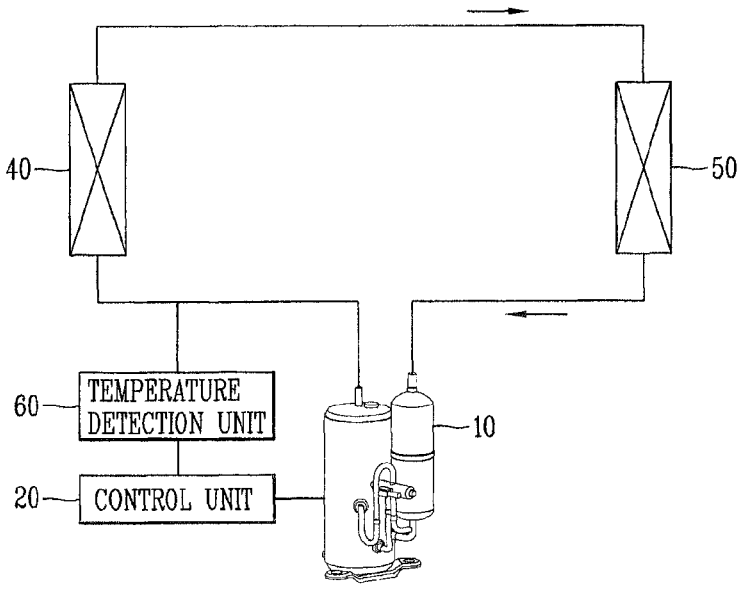
FIG. 4 is a schematic block diagram showing a system configuration to explain an air-conditioner according to a third or fourth exemplary embodiment of the present invention.

FIG. 4 is a schematic block diagram showing a system configuration to explain an air-conditioner according to a third or fourth exemplary embodiment of the present invention.

With reference to FIG. 4, an air-conditioner according to the third exemplary embodiment of the present invention includes the compressor 10 having a power mode in which the compressor 10 is operated with a maximum compression capacity and a saving mode in which the compressor 10 is operated with a smaller compression capacity than in the power mode; the temperature detection unit 60 configured to detect an actually measured temperature for determining an operation mode of the compressor 10; and the control unit 20 for changing the operation mode of the compressor by comparing the actually measured temperature which has been detected by the temperature detection unit to a pre-set reference temperature. In addition, the air-conditioner further includes an outdoor unit 40 for controlling distribution and circulation of a refrigerant, and an indoor unit 50 shared by the outdoor unit 40 and discharging air to each room. Here, if the actually measured temperature is higher than an upper limit of a temperature range corresponding to the power mode domain, the control unit may control the compressor to be operated in the saving mode. Here, the temperature range is a pre-set value. A reference temperature used for discriminating the power mode and the saving mode is a lower limit of the temperature range corresponding to the power mode domain, and one of temperature values higher than the lower limit is set to be an upper limit of the temperature range. If the actually measured temperature is higher than the upper limit of the temperature range, the control unit is forcibly changed to the saving mode.

The power mode is a compressor operation mode in which the compressor is operated with a maximum compression capacity, and the saving mode is a compressor operation mode in which the compressor is operated with a compression capacity ranging from 0 to 100% of the compression capacity of the power mode. 20%, 40%, 60% and 80% of the maximum compression capacity may be set for the saving mode, according to which the compressor may be operated, and most commonly, the compression capacity is set to be 50% to operate the compressor. This is called a two-stage mode.

The present invention is based on the two-stage mode of the power mode and the saving mode, for which every electrical or mechanical means dividing the two modes may be used.

In the general air-conditioner operation method, a saving mode operation and a power mode operation are divided based on a pre-set reference temperature. If a current temperature is lower than the pre-set reference temperature, the compressor is operated in the saving mode, whereas if the current temperature is higher than the pre-set reference temperature, the compressor is operated in the power mode. Over this operation method, an overload protection (OLP) device is commonly installed to protect the compressor provided in the air-conditioner, and in this case, if a compressor refrigerant discharge temperature exceeds the limit temperature of the overload protection device, the compressor is stopped to be protected.

Thus, the purpose of the present invention can be achieved by not exceeding the limit temperature of the overload protection device. Namely, in the air-conditioner according to the first exemplary embodiment of the present invention having the above-described configuration, the control unit controls the operation mode of the compressor by comparing the actually measured temperature detected by the temperature detection unit and the pre-set reference temperature according to the actually measured temperature detection period. Here, the actually measured temperature detection period refers to a period at which the actually measured temperature is compared with the pre-set reference temperature in real time whenever the actually measured temperature detected. In addition, the reference temperature is a value set to be lower than the limit temperature of the overload protection device as installed, which is used to prevent the compressor from being stopped by the overload protection device. The temperature detection unit may have the function of the overload protection device or may be installed separately from the overload protection device.

In the air-conditioner according to the third exemplary embodiment of the present invention, if the actually measured temperature is lower than a first reference temperature, the control unit 20 controls the compressor to be operated in the saving mode. If the actually measured temperature ranges from the first reference temperature to a second reference temperature, the control unit 20 controls the compressor to be operated in the power mode. If the actually measured temperature is higher than the second reference temperature, the control unit controls the compressor to be operated in the saving mode. Here, as described above with respect to the general air-conditioner operation method, the first reference temperature is a reference temperature value used for discriminating the saving mode and the power mode. The temperature range from the first reference temperature to the second reference temperature corresponds to a power mode domain. The second reference temperature is an upper limit temperature value of the temperature range corresponding to the power mode domain set to be lower than the limit temperature of the overload protection device in order to prevent the compressor from being stopped.

In the air-conditioner according to the third exemplary embodiment of the present invention, the temperature detection unit 60 may be installed at a discharge side of the compressor to detect the temperature of a refrigerant discharged from the compressor, or may be installed in an air-conditioned room to detect an indoor temperature.

The air-conditioner according to a fourth exemplary embodiment of the present invention will now be described with reference to FIG. 4.

The air-conditioner according to the fourth exemplary embodiment of the present invention includes: the compressor 10 having a power mode in which the compressor 10 is operated with a maximum compression capacity and a saving mode in which the compressor 10 is operated with a smaller compression capacity than in the power mode; and the control unit 20 configured to change an operation mode of the compressor according to each of pre-set time domains. The control unit 20 controls the compressor to be operated in the saving mode in a particular time domain of the time domains.

The air-conditioner according to the fourth exemplary embodiment of the present invention further includes: the temperature detection unit 60 configured to detect an actually measured temperature for determining an operation mode of the compressor. The control unit compares the actually measured temperature which has been detected by the temperature detection unit to a pre-set reference temperature, and if the actually measured temperature is higher than an upper limit of a temperature range corresponding to the power mode domain, the control unit may control the compressor to be operated in the saving mode. If the actually measured temperature is lower than a first reference temperature, the control unit may control the compressor to be operated in the saving mode. Here, the temperature range is a pre-set value. A reference temperature used for discriminating the power mode and the saving mode is a lower limit of the temperature range corresponding to the power mode domain, and one of temperature values higher than the lower limit is set to be an upper limit of the temperature range. If the actually measured temperature is higher than the upper limit of the temperature range, the control unit is forcibly changed to the saving mode.

Namely, in the air-conditioner according to the fourth exemplary embodiment of the present invention having the above-described configuration, the control unit controls the operation mode of the compressor by comparing the actually measured temperature detected by the temperature detection unit and the pre-set reference temperature according to the actually measured temperature detection period. Here, the actually measured temperature detection period refers to a period at which the actually measured temperature is compared with the pre-set reference temperature in real time whenever the actually measured temperature detected. In addition, the reference temperature is a value set to be lower than the limit temperature of the overload protection device as installed, which is used to prevent the compressor from being stopped by the overload protection device. The temperature detection unit may have the function of the overload protection device or may be installed separately from the overload protection device.

Also, in the air-conditioner according to the fourth exemplary embodiment of the present invention, if the actually measured temperature is lower than a first reference temperature, the control unit 20 controls the compressor to be operated in the saving mode. If the actually measured temperature ranges from the first reference temperature to a second reference temperature, the control unit 20 controls the compressor to be operated in the power mode. If the actually measured temperature is higher than the second reference temperature, the control unit controls the compressor to be operated in the saving mode. Here, as described above with respect to the general air-conditioner operation method, the first reference temperature is a reference temperature value used for discriminating the saving mode and the power mode. The temperature range from the first reference temperature to the second reference temperature corresponds to a power mode domain. The second reference temperature is an upper limit temperature value of the temperature range corresponding to the power mode domain set to be lower than the limit temperature of the overload protection device in order to prevent the compressor from being stopped.

Here, the time domain may be set based on a different reference such as 24 hours a day, etc., or may be set according to an average temperature.

In the air-conditioner according to the fourth exemplary embodiment of the present invention, the temperature detection unit 60 may be installed at a discharge side of the compressor to detect the temperature of a refrigerant discharged from the compressor, or may be installed in an air-conditioned room to detect an indoor temperature.

Figure 5:
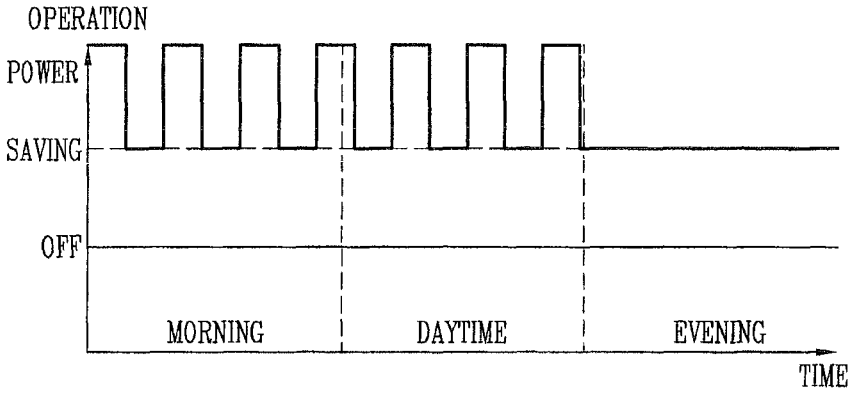
FIG. 5 is a graph showing a change in a compressor operation mode in FIG. 4.

FIG. 5 is a graph showing a change in the compressor operation mode, in which time is divided into the morning, day, night time slots, and operation mode is divided into the power mode and the saving mode.

First, when the user turns on power of the compressor, sets a desired temperature and drives the air-conditioner, the compressor is operated in the power mode so as to be driven to make an indoor temperature reach a user desired temperature. In addition, in a state that a certain temperature is previously set, if the temperature is lower than the pre-set certain temperature, the compressor is operated in the saving mode, whereas if the temperature is higher than the pre-set certain temperature, the compressor is operated in the power mode. In this case, in an area, such as a tropical area, where an average temperature is high, it is difficult to set a certain temperature and temperature is maintained at higher than the set temperature, so the control unit is continuously operated in the power mode. In the air-conditioner according to an exemplary embodiment of the present invention, for example, as shown in a morning time domain slot in FIG. 2, a new reference temperature is set to be within a temperature range higher than the pre-set certain temperature and lower than the limit temperature of the overload protection device, and when temperatures goes up to be higher than the newly set reference temperature, the compressor is forcibly changed to the saving mode. Thus, because the compressor is not continuously operated in the power mode, power consumption can be reduced and noise can be also reduced.

In the related art air-conditioner operation method, the operation of the compressor is stopped at a daytime slot during which an average temperature is high because an ambient temperature exceeds the limit temperature of the overload protection device. When the compressor is driven again by applying power thereto, because the ambient temperature exceeds again the limit temperature of the overload protection device, stopping the operation of the compressor. In a tropical area, in particular, during a daytime slot during which an average temperature is high, power of the compressor is repeatedly turned on or off, failing to provide an agreeable cooling operation and increase power consumption.

In comparison, according to the air-conditioner operation method according to an exemplary embodiment of the present invention, because the reference temperature is set to be lower than the limit value of the overload protection device and set for the upper limit of the temperature range of the power mode domain, and when an actually measured temperature is higher than the reference temperature, the compressor is forcibly changed to the saving mode and operated, thereby reducing power consumption and noise according to operation of the compressor such as a compressor operation noise and the like.

In an area, such as a tropical area, where an average temperature is high especially at nighttime slot, the high temperature is still maintained at the nighttime slot, so the compressor tends to be operated in the power mode. However, in the air-conditioner according to an exemplary embodiment of the present invention, a particular time domain is set, so that the compressor is operated in the particular operation mode. That is, for example, the compressor is operated in the saving mode during the nighttime slot, rather than being continuously operated in the power mode, thus preventing an excessive cooling operation and reducing noise.

Figure 6:
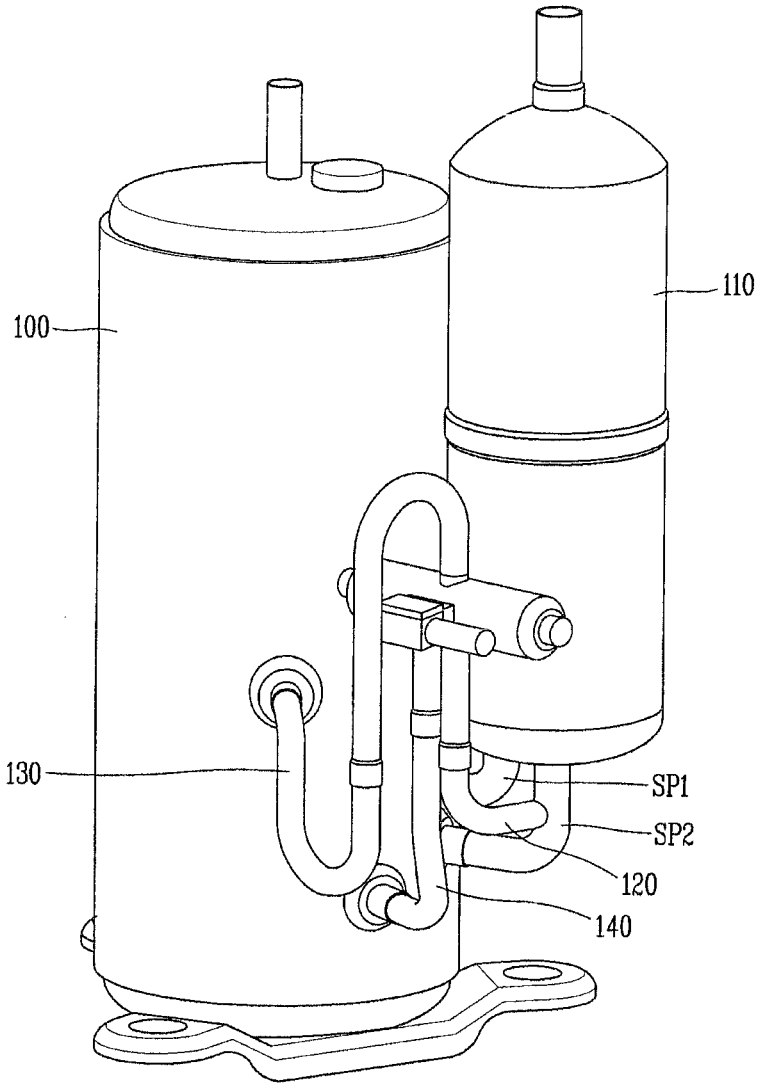
FIG. 6 is a perspective view showing the configuration of a compressor according to first to sixth exemplary embodiments of the present invention.

A compressor according to exemplary embodiments of the present invention will be described with reference to FIG. 6.

A compressor according to a first exemplary embodiment of the present invention includes a casing 100 having a hermetically closed internal space; a driving motor (not shown) installed in the internal space of the casing and generating a driving force; and a compression unit (not shown) installed along with the driving motor in the internal space of the casing, having at least two or more compression spaces, and controlled to be operated in a power mode or in a saving mode in which the compression unit is idly rotated in at least one compression space, according to a compressor application voltage. Here, if the application voltage is lower than a reference voltage, the compression unit controls the compressor to be operated in the saving mode, and when the application voltage is equal to or higher than the reference voltage, the compression unit controls the compressor to be operated in the power mode. Here, the reference voltage is a value previously set such that the compressor is prevented from being stopped due to a low voltage.

In the compressor according to the first exemplary embodiment of the present invention, when the application voltage is higher than the reference voltage, namely, when the application voltage is normal, and when the actually measured temperature is lower than a first reference temperature, the compression unit is changed to the saving mode. If the actually measured temperature ranges from the first reference temperature to a second reference temperature, the compression unit is changed to the power mode. If the actually measured temperature is higher than the second reference temperature, the compression unit is changed to the saving mode. Here, the first reference temperature is a reference temperature value used for discriminating the saving mode and the power mode. The temperature range from the first reference temperature to the second reference temperature corresponds to a power mode domain. The second reference temperature is an upper limit temperature value of the temperature range corresponding to the power mode domain set to be lower than the limit temperature of the overload protection device in order to prevent the compressor from being stopped.

The compressor 10 includes an accumulator 110 and a connection unit allowing a refrigerant to flow therethrough and connected to the outdoor unit 40 and the indoor unit 50. The connection unit includes a low pressure side connection pipe 120, a high pressure side connection pipe 130 connected with the internal space of the casing 100, and a common use side connection pipe 140 alternately connected with the low pressure side connection pipe 120 and the high pressure side connection pipe 130.

In the compressor according to the first exemplary embodiment of the present invention, the compression unit is changed to the saving mode during a particular time domain of a pre-set time domain. Here, the time domain may be set based on a different reference such as 24 hours a day, etc., or may be set according to an average temperature. A detailed description will be replaced by the description made above with reference to FIG. 2.

In the compressor according to the first exemplary embodiment of the present invention, the compression unit may be idly rotated by using a refrigerant sucked to a suction opening of the compression unit and a refrigerant filled in the internal space of the casing 100.

A compressor according to a second exemplary embodiment of the present invention includes a casing 100 having a hermetically closed internal space, a driving motor (not shown) installed in the internal space of the casing and generating a driving force, a compression unit (not shown) installed along with the driving motor in the internal space of the casing, having at least two or more compression spaces, and controlled to be operated in a power mode or in a saving mode in which the compression unit is idly rotated in at least one compression space, according to a compressor application voltage, a plurality of cylinders each having a separated compression space and installed in the internal space of the casing 100, a suction pipe for distributedly supplying a refrigerant to the compression spaces of the plurality of cylinders, a plurality of rolling pistons for compressing the refrigerant while making a rotating movement in the compression spaces of the cylinders, a plurality of vanes dividing the compression spaces of the cylinders into suction spaces and discharge spaces together with the rolling pistons, and a vain restraining unit for varying the operation mode of the compressor by restraining or releasing a vane of a cylinder among the vanes. Here, if the application voltage is lower than a reference voltage, the compression unit controls the compressor to be operated in the saving mode, and when the application voltage is equal to or higher than the reference voltage, the compression unit controls the compressor to be operated in the power mode. Here, the reference voltage is a value previously set such that the compressor is prevented from being stopped due to a low voltage.

Here, in the compressor, one side of at least one of the vanes has a sealing surface being in contact with the rolling piston, and the other side of the sealing surface has a pressure surface pressing the vane toward the rolling piston.

A chamber is formed at the pressure surface of the vane of one of the cylinders, which is separated from the internal space of the casing and filled with a refrigerator of suction pressure or discharge pressure.

The compressor further includes a mode conversion unit formed at an outer side of the casing to selectively provide the refrigerant of suction pressure or discharge pressure to the pressure surface of the vane.

In the compressor according to the second exemplary embodiment of the present invention, the mode conversion unit includes: a mode conversion valve for selecting the refrigerant of suction pressure or discharge pressure at the vane, a low pressure side connection pipe for connecting a first entrance of the mode conversion valve and a suction pipe, a high pressure side connection pipe for connecting a second entrance of the mode conversion valve and the internal space of the casing, and a common side connection pipe connected with an exit of the move conversion valve and the pressure surface of the vane.

In the compressor according to the second exemplary embodiment of the present invention, when the application voltage is higher than the reference voltage, namely, when the application voltage is normal, and when the actually measured temperature is lower than a first reference temperature, the compression unit is changed to the saving mode. If the actually measured temperature ranges from the first reference temperature to a second reference temperature, the compression unit is changed to the power mode. If the actually measured temperature is higher than the second reference temperature, the compression unit is changed to the saving mode. Here, the first reference temperature is a reference temperature value used for discriminating the saving mode and the power mode. The temperature range from the first reference temperature to the second reference temperature corresponds to a power mode domain. The second reference temperature is an upper limit temperature value of the temperature range corresponding to the power mode domain set to be lower than the limit temperature of the overload protection device in order to prevent the compressor from being stopped.

A compressor according to a third exemplary embodiment of the present invention includes a casing 100 having a hermetically closed internal space, a driving motor (not shown) installed in the internal space of the casing and generating a driving force, a compression unit (not shown) installed along with the driving motor in the internal space of the casing, having at least two or more compression spaces, and controlled to be operated in a power mode or in a saving mode in which the compression unit is idly rotated in at least one compression space, according to a compressor application voltage, a plurality of cylinders each having a separated compression space and installed in the internal space of the casing 100, a suction pipe for distributedly supplying a refrigerant to the compression spaces of the plurality of cylinders, a plurality of rolling pistons for compressing the refrigerant while making a rotating movement in the compression spaces of the cylinders, a plurality of vanes dividing the compression spaces of the cylinders into suction spaces and discharge spaces together with the rolling pistons, and a vain restraining unit for varying the operation mode of the compressor by restraining or releasing a vane of a cylinder among the vanes, wherein at least one of the vanes is restrained by pressure in the internal space of the casing. Here, if the application voltage is lower than a reference voltage, the compression unit controls the compressor to be operated in the saving mode, and when the application voltage is equal to or higher than the reference voltage, the compression unit controls the compressor to be operated in the power mode. Here, the reference voltage is a value previously set such that the compressor is prevented from being stopped due to a low voltage.

In the compressor according to the third exemplary embodiment of the present invention, at least one of the cylinders communicates with a vane slot allowing the vane to move in a radial direction, and at least one first restraining hole is formed substantially in a right angle direction with respect to a direction in which the vane is moved in the vane slot and communicates with the internal space of the casing.

In the compressor, the cylinder includes a second restraining hole formed to communicate with the suction hole at the opposite side of the first restraining hole based on the vane slot.

In the compressor according to the third exemplary embodiment of the present invention, when the application voltage is higher than the reference voltage, namely, when the application voltage is normal, and when the actually measured temperature is lower than a first reference temperature, the compression unit is changed to the saving mode. If the actually measured temperature ranges from the first reference temperature to a second reference temperature, the compression unit is changed to the power mode. If the actually measured temperature is higher than the second reference temperature, the compression unit is changed to the saving mode. Here, the first reference temperature is a reference temperature value used for discriminating the saving mode and the power mode. The temperature range from the first reference temperature to the second reference temperature corresponds to a power mode domain. The second reference temperature is an upper limit temperature value of the temperature range corresponding to the power mode domain set to be lower than the limit temperature of the overload protection device in order to prevent the compressor from being stopped.

A compressor according to a fourth exemplary embodiment of the present invention includes a casing 100 having a hermetically closed internal space, a driving motor (not shown) installed in the internal space of the casing and generating a driving force, a compression unit (not shown) installed along with the driving motor in the internal space of the casing, having at least two or more compression spaces, and controlled to be operated in a power mode or in a saving mode in which the compression unit is idly rotated in at least one compression space, according to the difference of actually measured temperatures of refrigerants discharged from the compression spaces. When the actually measured temperature is lower than a first reference temperature, the compression unit is changed to the saving mode. If the actually measured temperature ranges from the first reference temperature to a second reference temperature, the compression unit is changed to the power mode. If the actually measured temperature is higher than the second reference temperature, the compression unit is changed to the saving mode. Here, the first reference temperature is a reference temperature value used for discriminating the saving mode and the power mode. The temperature range from the first reference temperature to the second reference temperature corresponds to a power mode domain. The second reference temperature is an upper limit temperature value of the temperature range corresponding to the power mode domain set to be lower than the limit temperature of the overload protection device in order to prevent the compressor from being stopped.

The compressor includes the accumulator 110 and the connection unit allowing a refrigerant to flow therethrough and connected to the outdoor unit 40 and the indoor unit 50. The connection unit includes a low pressure side connection pipe 120, a high pressure side connection pipe 130 connected with the internal space of the casing 100, and a common use side connection pipe 140 alternately connected with the low pressure side connection pipe 120 and the high pressure side connection pipe 130.

In the compressor according to the fourth exemplary embodiment of the present invention, the compression unit is changed to the saving mode during a particular time domain of a pre-set time domain. Here, the time domain may be set based on a different reference such as 24 hours a day, etc., or may be set according to an average temperature. A detailed description will be replaced by the description made above with reference to FIG. 2.

In the compressor according to the fourth exemplary embodiment of the present invention, the compression unit may be idly rotated by using a refrigerant sucked to a suction opening of the compression unit and a refrigerant filled in the internal space of the casing.

A compressor according to a fifth exemplary embodiment of the present invention includes a casing having a hermetically closed internal space, a driving motor installed in the internal space of the casing and generating a driving force, a compression unit installed along with the driving motor in the internal space of the casing, having at least two or more compression spaces, and controlled to be operated in a power mode or in a saving mode in which the compression unit is idly rotated in at least one compression space, according to the difference of actually measured temperatures of the refrigerants discharged from the compression spaces, a plurality of cylinders each having a separated compression space and installed in the internal space of the casing 100, a suction pipe for distributedly supplying a refrigerant to the compression spaces of the plurality of cylinders, a plurality of rolling pistons for compressing the refrigerant while making a rotating movement in the compression spaces of the cylinders, a plurality of vanes dividing the compression spaces of the cylinders into suction spaces and discharge spaces together with the rolling pistons, and a vain restraining unit for varying the operation mode of the compressor by restraining or releasing a vane of a cylinder among the vanes. Here, when the actually measured temperature is lower than a first reference temperature, the compression unit is changed to the saving mode. If the actually measured temperature ranges from the first reference temperature to a second reference temperature, the compression unit is changed to the power mode. If the actually measured temperature is higher than the second reference temperature, the compression unit is changed to the saving mode.

Here, in the compressor, one side of at least one of the vanes has a sealing surface being in contact with the rolling piston, and the other side of the sealing surface has a pressure surface pressing the vane toward the rolling piston.

A chamber is formed at the pressure surface of the vane of one of the cylinders, which is separated from the internal space of the casing and filled with a refrigerator of suction pressure or discharge pressure.

The compressor further includes a mode conversion unit formed at an outer side of the casing to selectively provide the refrigerant of suction pressure or discharge pressure to the pressure surface of the vane.

In the compressor according to the fifth exemplary embodiment of the present invention, the mode conversion unit includes: a mode conversion valve for selecting the refrigerant of suction pressure or discharge pressure at the vane, a low pressure side connection pipe for connecting a first entrance of the mode conversion valve and a suction pipe, a high pressure side connection pipe for connecting a second entrance of the mode conversion valve and the internal space of the casing, and a common side connection pipe connected with an exit of the move conversion valve and the pressure surface of the vane.

A compressor according to a sixth exemplary embodiment of the present invention includes a casing having a hermetically closed internal space, a driving motor installed in the internal space of the casing and generating a driving force, a compression unit installed along with the driving motor in the internal space of the casing, having at least two or more compression spaces, and controlled to be operated in a power mode or in a saving mode in which the compression unit is idly rotated in at least one compression space, according to the difference of actually measured temperatures of the refrigerants discharged from the compression spaces, a plurality of cylinders each having a separated compression space and installed in the internal space of the casing 100, a suction pipe for distributedly supplying a refrigerant to the compression spaces of the plurality of cylinders, a plurality of rolling pistons for compressing the refrigerant while making a rotating movement in the compression spaces of the cylinders, a plurality of vanes dividing the compression spaces of the cylinders into suction spaces and discharge spaces together with the rolling pistons, and a vain restraining unit for varying the operation mode of the compressor by restraining or releasing a vane of a cylinder among the vanes, wherein at least one of the vanes is restrained by pressure in the internal space of the casing. Here, when the actually measured temperature is lower than a first reference temperature, the compression unit is changed to the saving mode. If the actually measured temperature ranges from the first reference temperature to a second reference temperature, the compression unit is changed to the power mode. If the actually measured temperature is higher than the second reference temperature, the compression unit is changed to the saving mode.

In the compressor according to the sixth exemplary embodiment of the present invention, at least one of the cylinders communicates with a vane slot allowing the vane to move in a radial direction, and at least one first restraining hole is formed substantially in a right angle direction with respect to a direction in which the vane is moved in the vane slot and communicates with the internal space of the casing.

In the compressor, the cylinder includes a second restraining hole formed to communicate with the suction hole at the opposite side of the first restraining hole based on the vane slot.

Figure 7:
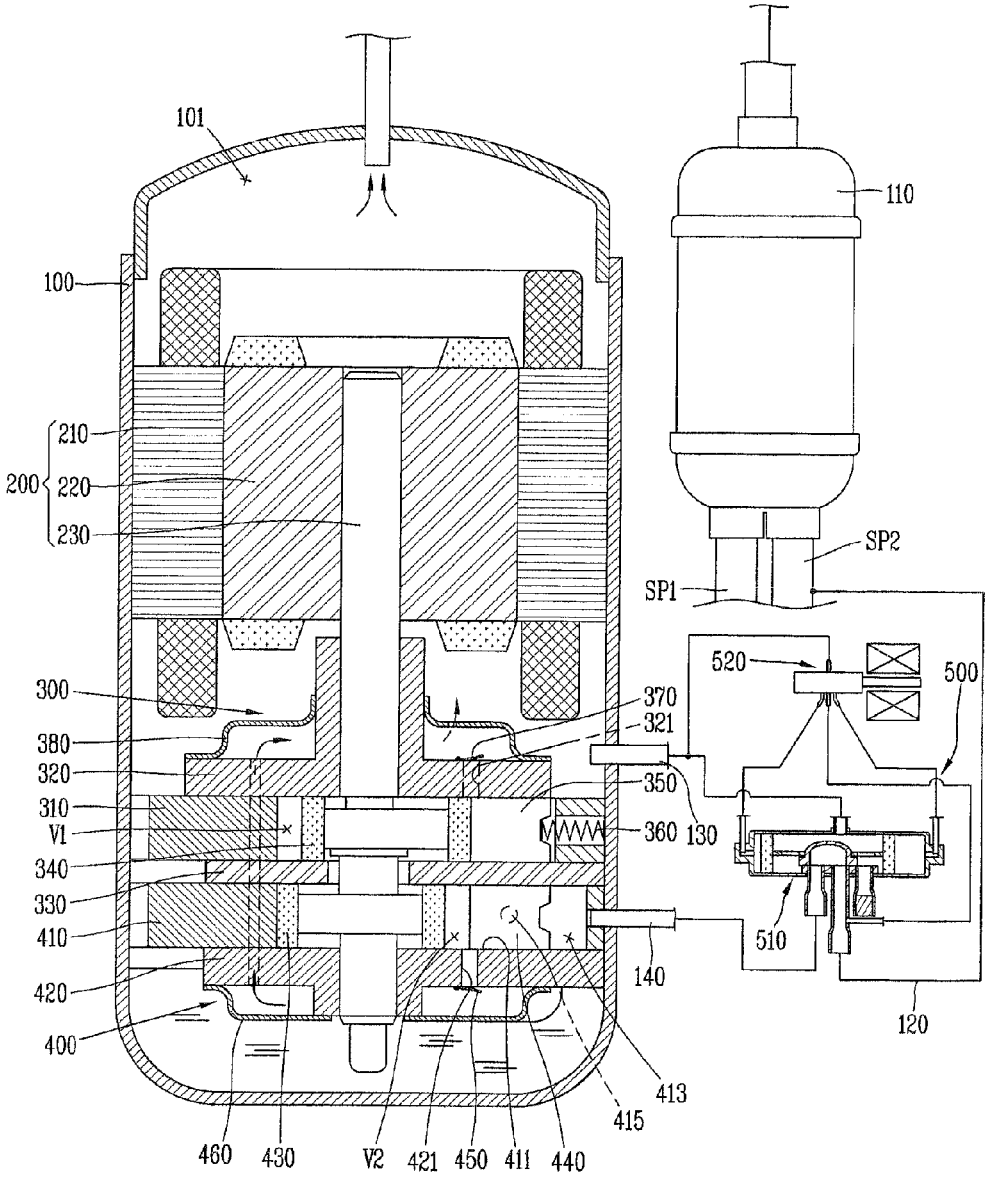
FIG. 7 is a vertical-sectional view showing the configuration of a compressor according to an exemplary embodiment of the present invention.

The structure of a compressor according to exemplary embodiments of the present invention will now be described with reference to FIGS. 6 and 7.

A compressor according to an exemplary embodiment of the present invention includes a casing 100 including a plurality of gas suction pipes SP1 and SP2 and a single gas discharge pipe DP connected thereto, a driving motor 200 installed at an upper portion of the casing 100 and generating a driving force, first and second compression mechanism units 300 and 400 installed at a lower portion of the casing 100 and compressing a refrigerant with a rotational force generated from the driving motor 200, a valve unit 500 allowing the second compression mechanism unit 400 to be operated in the power mode or saving mode by changing a rear surface of a second vane 440 of the second compression mechanism unit to a high pressure atmosphere or a low pressure atmosphere, and a connection unit 600 connecting the valve unit 500 to the casing 100 and the second compression mechanism unit 400 to allow the second compression mechanism unit 400 to be controlled by the valve unit 500. Here, the first and second compression mechanism units 300 and 400 constitute a compression unit.

The driving motor 200 is a motor performing a constant speed driving or an inverter driving. The driving motor 200 includes a stator 210 fixed within the casing 100 and receiving power applied from the exterior, a rotor 220 disposed with a certain gap within the stator 210 and rotated while interworking with the stator 210, and a rotational shaft 230 coupled to the rotor 220 and transferring a rotational force to the first and second compression mechanism units 300 and 400.

The first compression mechanism unit 300 includes a first cylinder 300 formed as a portion of a first cylinder assembly, having an annular shape and installed within the casing 110, and upper and lower bearing plates (upper and lower bearings 320 and 330 coupled at both upper and lower sides of the first cylinder 310 to constitute a first cylinder assembly.

The first compression mechanism unit 300 further includes a first rolling piston 340 rotatably coupled to an upper eccentric portion of the rotational shaft 230 and compressing a refrigerant while making a rotational movement in a first compression space V1 of the first cylinder, and a first vane 350 coupled to be movable in a radial direction to the first cylinder 310 such that it is pressed to be brought into contact with an outer circumferential surface of the first rolling piston 340 and dividing the first compression space V1 of the first cylinder 310 into a first suction chamber and a first compression chamber.

The first compression mechanism unit 300 further includes a vane support spring 360 formed as a compression spring to elastically support a rear side of the vane 350, a first discharge valve 370 coupled to a front end of a first discharge opening 321 provided at a central portion of the upper bearing 320 and adjusting a refrigerant gas discharged from the compression chamber of the first compression space V1, and a first muffler 380 having an internal volume to accommodate the first discharge valve 370 and coupled to the upper bearing 320.

The second compression mechanism unit 400 includes a second cylinder 410 formed as a portion of a second cylinder assembly, having an annular shape and installed at a lower side of the first cylinder 310 within the casing 110, and an intermediate bearing 330 and a lower bearing 420 coupled to both upper and lower sides of the second cylinder 410 to constitute the second cylinder assembly having a second compression space V2 together with the second cylinder 410.

The second compression mechanism 400 further includes a second rolling piston 430 rotatably coupled to a lower eccentric portion of the rotational shaft 230 and compressing the refrigerant while making a rotational movement within the second compression space V2 of the second cylinder 410, and a second vane 440 coupled to be movable in a radial direction to the second cylinder 410 such that it is pressed to be brought into contact with or separated from an outer circumferential surface of the second rolling piston 430 and dividing the second compression space V2 of the second cylinder 410 into a second suction chamber and a second compression chamber, or connecting them.

The second compression mechanism unit 400 further includes a second discharge valve 450 coupled to a front end of a second discharge opening 421 provided at a central portion of the lower bearing 420 and adjusting a refrigerant gas discharged from the second compression chamber, and a second muffler 460 having a certain internal volume to accommodate the second discharge valve 450 and coupled to the lower bearing 420.

The second cylinder 410 includes a second vane slot 411 formed at one side of an inner circumferential surface constituting the second compression space V2 to allow the second vane 440 to make a reciprocal movement in a radial direction, a second suction opening 412 formed at one side of the second vane slot 411 in a radial direction to guide the refrigerant to the second compression space V2, and a second discharge guide groove (not shown) formed to be sloped in an axial direction at another side of the second vane slot 411 to allow the refrigerant to be discharged to the interior of the casing 100.

A vane chamber 413 is formed at a radially rear side of the second vane slot 411, hermetically closed by being connected with a common side connection pipe 630 of the connection unit 600 (to be described) and separated from the interior of the casing 100 to provide a suction pressure (Ps) or a discharge pressure (Pd) to the rear side of the second vane 440. The vane chamber 413 is formed to have a certain internal volume and connected with the common side connection pipe 630 in order to allow a rear surface of the second vane 440 to form a pressure surface with respect to pressure supplied through the common side connection pipe 630 even if the second vane 440 moves backward completely and received at the inner side of the second vane slot 411.

In the second cylinder 410, a first flow path 414 is formed to connect the interior of the casing 100 and the second vane slot 411 in a direction perpendicular to a movement direction of the second vane 440 or in a direction having a certain crossing angle to thus allow the second vane 440 to be restraining by the discharge pressure Pd of an internal space 101 of the casing 100, and a second flow path 415 is formed at the opposite side of the first flow path 414 to quickly restrain the second vane 440 according to a pressure difference between the first and second flow paths 414 and 415 as the second vane slot 411 and the second suction opening 412 are connected. The first and second flow paths 414 and 415 may be formed on the same straight line or may have the same sectional area.

The valve unit 500 includes a main valve unit 510 connected to the vane chamber 412 of the second cylinder 410, and a sub-valve unit 520 connected with the main valve unit 510 and controlling an opening and closing operation of the main valve unit 510.

The connection unit 600 includes a low pressure side connection pipe 120 branched from the second gas suction pipe SP2 and connected to the main valve unit 510, a high pressure side connection pipe 130 connected with the internal space 101 of the casing 100 so as to be connected to the main valve unit 510, and a common side connection pipe 140 connected with the vane chamber 412 of the second cylinder 410 so as to be alternately connected with the low pressure connection pipe 120 and the high pressure side connection pipe 130.

Here, preferably, one side of the high pressure side connection pipe 130 connected with the casing 100 is positioned between a lower end of the electric mechanism unit 200 and an upper end of the first compression mechanism unit 300 so as to be connected to be higher than the surface of oil to prevent oil from being introduced into the vane chamber 41.

Although not shown, an oil blocking net may be formed at the entrance of the high pressure side connection pipe 130 or an oil blocking plate may be installed to be open downwardly to effectively prevent an introduction of oil, and the high pressure side connection pipe 130 may be disposed to become higher as it becomes away from a connection point to allow oil introduced to the high pressure side connection pipe 130 to flow to the casing 100 to thus more effectively prevent introduction of oil.

The operation of the compressor according to exemplary embodiments of the present invention will now be described.

When power is applied to the stator 210 of the driving motor 200 so the rotor 220 is rotated, the rotational shaft 230 is rotated together with the rotor 220 to transfer a rotational force of the driving motor 200 to the first and second compression mechanism units 300 and 400. Then, the first and second compression mechanism units 300 and 400 are all perform power operation to generate a large cooling capacity, or only the first compression mechanism unit 300 may perform power operation while the second compression mechanism unit 400 perform saving operation to generate a small cooling capacity. Here, the first and second compression mechanism units 300 and 400 constitute a compression unit.

Here, when the compressor performs power operation, a high pressure refrigerant within the casing 100 is introduced to the vane chamber 413 through the high pressure side connection pipe 130 by the main valve unit 510 and the sub-valve unit 520, and because the high pressure refrigerant introduced into the vane chamber 413 supports the second vane 440, the second compression mechanism unit 400 as well as the first compression mechanism unit 300 is normally operated to compress the refrigerant.

Meanwhile, when the compressor perform saving operation, a low pressure refrigerant sucked to the second cylinder 410 via the gas suction pipe SP2 is introduced to the vane chamber 413 through the low pressure side connection pipe 120 by the main valve unit 510 and the sub-valve unit 520, so the low pressure refrigerant introduced into the vane chamber 413 supports the rear surface of the second vane 440 while the pressure force in the second compression space V2 is applied to the front surface of the second vane 440, separating the second vane 440 from the second rolling piston 430. And, because a pressure difference applied to both sides of the second vane 440 is increased by the first and second flow paths 414 and 415 provided at the second cylinder 410, the second vane 440 is quickly and effectively restrained. For example, because the high pressure oil or refrigerant is introduced to the first flow path 414 and, at the same time, it is quickly leaked to the second suction opening 412 through the gap between the second vane 440 and the vain slot 411 and the second flow path 415, when the operation mode of the compressor is changed, the second vane 440 is quickly and stably restrained. Accordingly, compression is normally made only in the first compression mechanism unit 300, while the second compression mechanism unit does not perform compression.

As so far described, the compressor and the air-conditioner having the same have the following advantages.

That is, voltage applied to the compressor is detected, or voltage applied to the compressor is detected, temperature of a refrigerant discharged from the compressor or an ambient temperature is detected to operate the air-conditioner in a pre-set operation mode or operate the air-conditioner in a pre-set operation mode in a certain time domain, to thus continuously operate the compressor, thereby improving the reliability and operation efficiency of the compressor and air-conditioner and reducing noise.

Second, the temperature of the refrigerant discharged from the compressor of the ambient temperature are detected to operate the air-conditioner in a pre-set operation mode or operate the air-conditioner in a pre-set operation mode in a certain time domain, to thus continuously operate the compressor, thereby improving the reliability and operation efficiency of the compressor and air-conditioner and reducing noise.

In the above description, the compressor application voltage is detected, and the compressor is operated based on the detected application voltage, but the present invention can be also applicable to a method in which a compressor application current is detected and the compressor is operated based on the detected application current.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An air-conditioner comprising:

a compressor having a power mode in which the compressor is operated with a maximum compression capacity and a saving mode in which the compressor is operated with a smaller compression capacity than in the power mode;

a voltage detector that detects an application voltage to determine an operation mode of the compressor;

a temperature detector that detects an actually measured temperature to determine the operation mode of the compressor; and a controller that changes the operation mode of the compressor, wherein the controller divides a day into a plurality of pre-set time domains and controls the compressor to be operated in the saving mode during at least one pre-set time domain of the plurality of pre-set time domains, wherein the controller compares the application voltage detected by the voltage detector and a first and second reference voltage according to an application voltage detection period, and when the application voltage is higher than the first reference voltage, the controller controls the compressor to be operated in the power mode, when the application voltage ranges from the first reference voltage to the second reference voltage, the controller controls the compressor to be operated in the saving mode, and when the application voltage is lower than the second reference voltage, the controller controls the compressor to be stopped, and upon determination that the application voltage detected by the voltage detector is higher than the first reference voltage, the controller compares the actually measured temperature detected by the temperature detector and a first and second reference temperature according to an actually measured temperature detection period, and when the actually measured temperature is lower than the first reference temperature, the controller controls the compressor to be operated in the saving mode, when the actually measured temperature is equal to or higher than the first reference temperature but lower than the second reference temperature, the controller controls the compressor to be operated in the power mode, and when the actually measured temperature is equal to or higher than the second reference temperature, the controller controls the compressor to be operated in the saving mode.

2. The air-conditioner of claim 1, wherein the controller controls the compressor to be operated in the saving mode when the actually measured temperature is higher than an upper limit of a temperature range corresponding to a power mode domain.

3. An air-conditioner comprising:

a compressor having a power mode in which the compressor is operated with a maximum compression capacity and a saving mode in which the compressor is operated with a smaller compression capacity than in the power mode, the compressor including:

a casing having a hermetically closed internal space;

a drive motor installed in the internal space of the casing and that generates a drive force; and a compression device installed along with the drive motor in the internal space of the casing, having at least two or more compression spaces, and controlled to be operated in the power mode or in the saving mode in which the compression device is idly rotated in at least one compression space according to an application voltage, wherein if the application voltage is lower than a reference voltage, the compression device controls the compressor to be operated in the saving mode, and if the application voltage is equal to or higher than the reference voltage, the compression device controls the compressor to be operated in the power mode;

a voltage detector that detects the application voltage to determine an operation mode of the compressor;

a temperature detector that detects an actually measured temperature to determine an operation mode of the compressor; and a controller that changes the operation mode of the compressor, wherein the controller divides a day into a plurality of pre-set time domains and controls the compressor to be operated in the saving mode during at least one pre-set time domain of the plurality of pre-set time domains, and upon determination that the application voltage is higher than the reference voltage, the controller compares the actually measured temperature detected by the temperature detector with a first reference temperature and a second reference temperature, which are pre-set during an actually measured temperature detection period and correspond to the at least one time domain, and when the actually measured temperature is lower than the first reference temperature, the controller controls the compressor to be operated in the saving mode, when the actually measured temperature is equal to or higher than the first reference temperature but lower than the second reference temperature, the controller controls the compressor to be operated in the power mode, and when the actually measured temperature is equal to or higher than the second reference temperature, the controller controls the compressor to be operated in the saving mode.

4. The air-conditioner of claim 3, wherein the at least one time domain is set based on an average temperature.

5. The air-conditioner of claim 3, wherein the compression device is idly rotated by a refrigerant sucked into a suction opening of the compression device and a refrigerant filled in the internal space of the casing.

6. The air-conditioner of claim 3, wherein the compressor further includes:

a plurality of cylinders each having a separated compression space and installed in the internal space of the casing;

a suction pipe that distributedly supplies a refrigerant to the compression spaces of the plurality of cylinders;

a plurality of rolling pistons to compress the refrigerant while making a rotating movement in the compression spaces of the cylinders;

a plurality of vanes that divide the compression spaces of the cylinders into suction spaces and discharge spaces together with the rolling pistons; and a vane restrainer to vary the operation mode of the compressor by restraining or releasing a vane of a cylinder among the plurality of vanes.

7. The air-conditioner of claim 6, wherein one side of at least one vane of the plurality of vanes has a sealing surface in contact with the rolling piston, and another side of the sealing surface has a pressure surface that presses the vane toward the rolling piston.

8. The air-conditioner of claim 7, wherein a chamber is formed at the pressure surface of the vane of one of the cylinders, which is separated from the internal space of the casing and filled with a refrigerant of suction pressure or discharge pressure.

9. The air-conditioner of claim 7, wherein the compressor further includes a mode conversion device formed at an outer side of the casing to selectively provide the refrigerant of suction pressure or discharge pressure to the pressure surface of the vane.

10. The air-conditioner of claim 9, wherein the mode conversion device includes:

a mode conversion valve that selects the refrigerant of suction pressure or discharge pressure at the vane;

a low pressure side connection pipe that connects a first entrance of the mode conversion valve and a suction pipe;

a high pressure side connection pipe that connects a second entrance of the mode conversion valve and the internal space of the casing; and a common side connection pipe that connects an exit of the move conversion valve and the pressure surface of the vane.

11. The air-conditioner of claim 6, wherein at least one of the plurality of vanes is restrained by a pressure in the internal space of the casing.

12. The air-conditioner of claim 11, wherein at least one of the cylinders communicates with a vane slot to allow the vane to move in a radial direction, and at least one first restraining hole is formed substantially in a right angle direction with respect to a direction in which the vane is moved in the vane slot and communicates with the internal space of the casing.

13. The air-conditioner of claim 3, wherein the compression device is idly rotated by a refrigerant sucked into a suction opening of the compression device and a refrigerant filled in the internal space of the casing.

14. The air-conditioner of claim 3, wherein the compressor further includes:

a plurality of cylinders each having a separated compression space and installed in the internal space of the casing;

a suction pipe that distributedly supplies a refrigerant to the compression spaces of the plurality of cylinders;

a plurality of rolling pistons to compress the refrigerant while making a rotating movement in the compression spaces of the cylinders;

a plurality of vanes that divide the compression spaces of the cylinders into suction spaces and discharge spaces together with the rolling pistons; and a vane restrainer to vary the operation mode of the compressor by restraining or releasing a vane of a cylinder among the vanes.

15. The air-conditioner of claim 14, wherein one side of at least one of the plurality of vanes has a sealing surface in contact with the rolling piston, and another side of the sealing surface has a pressure surface that presses the vane toward the rolling piston.

16. The air-conditioner of claim 15, wherein a chamber is formed at the pressure surface of the vane of one of the cylinders, which is separated from the internal space of the casing and filled with a refrigerant of suction pressure or discharge pressure.

17. The air-conditioner of claim 15, wherein the compressor further includes a mode conversion device formed at an outer side of the casing to selectively provide the refrigerant of suction pressure or discharge pressure to the pressure surface of the vane.

18. The air-conditioner of claim 17, wherein the mode conversion device includes:

a mode conversion valve that selects the refrigerant of suction pressure or discharge pressure at the vane;

a low pressure side connection pipe that connects a first entrance of the mode conversion valve and a suction pipe;

a high pressure side connection pipe that connects a second entrance of the mode conversion valve and the internal space of the casing; and a common side connection pipe that connects an exit of the move conversion valve and the pressure surface of the vane.

19. The air-conditioner of claim 14, wherein at least one of the plurality of vanes is restrained by the pressure in the internal space of the casing.

20. The aft-conditioner of claim 19, wherein at least one of the cylinders communicates with a vane slot to allow the vane to move in a radial direction, and at least one first restraining hole is formed substantially in a right angle direction with respect to a direction in which the vane is moved in the vane slot and communicates with the internal space of the casing.

* * * * *